US008656604B2

(12) United States Patent
Ediger et al.

(10) Patent No.: US 8,656,604 B2
(45) Date of Patent: Feb. 25, 2014

(54) CONDENSATION DRYER WITH A HOUSING

(75) Inventors: Rainer Ediger, Berlin (DE); Thomas Nawrot, Berlin (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 447 days.

(21) Appl. No.: 13/128,644

(22) PCT Filed: Dec. 2, 2009

(86) PCT No.: PCT/EP2009/066233

§ 371 (c)(1),
(2), (4) Date: May 11, 2011

(87) PCT Pub. No.: WO2010/063760

PCT Pub. Date: Jun. 10, 2010

(65) Prior Publication Data

US 2011/0209357 A1 Sep. 1, 2011

(30) Foreign Application Priority Data

Dec. 3, 2008 (DE) ..... 10 2008 044 323

(51) Int. Cl.
*F26B 11/02* (2006.01)

(52) U.S. Cl.
USPC ..... 34/595; 34/603; 34/606; 134/30; 62/457.9; 8/159; 68/20

(58) Field of Classification Search
USPC ..... 34/595, 601, 603, 606, 610; 134/10, 30; 8/137, 159; 68/3 R, 5 R, 19, 20; 62/3.3, 62/3.7, 457.9
See application file for complete search history.

(56) References Cited

U.S. PATENT DOCUMENTS 2,660,806 A * 12/1953 Whitesel ..... 34/77
4,621,438 A * 11/1986 Lanciaux ..... 34/77

(Continued)

FOREIGN PATENT DOCUMENTS

CN 101173440 A 5/2008
CN 101173481 A 5/2008

(Continued)

OTHER PUBLICATIONS

International Search Report PCT/EP2009/066233.

(Continued)

*Primary Examiner* — Steve M Gravini
(74) *Attorney, Agent, or Firm* — James E. Howard; Andre Pallapies

(57) ABSTRACT

A condensation dryer includes a housing having a wall area which forms a rear side, and a process air circuit for circulating process air. The process air circuit has a first section outside the housing and running along the wall area and a remaining second section inside the housing. The first section which is located at the wall area is formed by a profile part placed on the wall area and is covered by a hood placed in sealing fashion on the wall area. A fan is arranged in the process air circuit for circulating the process air, and a drying chamber is arranged in the process air circuit for holding objects to be dried. A heat pump is disposed in the housing and includes a heat sink which is thermally coupled to the process air circuit, and a heat source, which is thermally coupled to the process air circuit.

10 Claims, 3 Drawing Sheets

(56) References Cited

U.S. PATENT DOCUMENTS

| | | | | |
|---|---|---|---|---|
| 5,361,511 | A * | 11/1994 | Brown | 34/468 |
| 6,957,501 | B2 | 10/2005 | Park et al. | |
| 7,024,795 | B2 * | 4/2006 | Tadano et al. | 34/76 |
| 7,866,061 | B2 * | 1/2011 | Tatsumi et al. | 34/595 |
| 7,926,202 | B2 * | 4/2011 | Dittmer et al. | 34/595 |
| 8,079,157 | B2 * | 12/2011 | Balerdi Azpilicueta et al. | 34/130 |
| 8,499,473 | B2 * | 8/2013 | Dal Ben et al. | 34/603 |
| 2005/0044744 | A1 * | 3/2005 | Tadano et al. | 34/596 |
| 2007/0256322 | A1 | 11/2007 | Kim et al. | |
| 2009/0038175 | A1 | 2/2009 | Ziemann | |
| 2009/0094852 | A1 * | 4/2009 | Tatsumi et al. | 34/132 |
| 2009/0113747 | A1 | 5/2009 | Nawrot et al. | |
| 2010/0101606 | A1 | 4/2010 | Grunert | |
| 2010/0275457 | A1 | 11/2010 | Balerdi Azpilicueta et al. | |
| 2011/0041355 | A1 * | 2/2011 | Kuhl et al. | 34/282 |
| 2011/0209357 | A1 * | 9/2011 | Ediger et al. | 34/595 |
| 2011/0277334 | A1 * | 11/2011 | Lee et al. | 34/73 |
| 2012/0047759 | A1 * | 3/2012 | Ben et al. | 34/108 |
| 2012/0060387 | A1 * | 3/2012 | Wang | 34/86 |
| 2013/0008049 | A1 * | 1/2013 | Patil | 34/469 |

FOREIGN PATENT DOCUMENTS

| | | | | |
|---|---|---|---|---|
| DE | 202006018205 | U1 | 2/2007 | |
| DE | 102008044323 | A1 * | 6/2010 | D06F 58/20 |
| EP | 0467188 | B1 | 4/2001 | |
| JP | 2009207673 | A * | 9/2009 | |
| WO | 2006126815 | A2 | 11/2006 | |
| WO | 2008119608 | A2 | 10/2008 | |

OTHER PUBLICATIONS

Report of Examination CN 200980148769.5.

* cited by examiner

CONDENSATION DRYER WITH A HOUSING

BACKGROUND OF THE INVENTION

The invention relates to a condensation dryer with a housing, comprising a wall area forming a rear side and with a process air circuit for circulating process air, said circuit having a section outside the housing and running along the wall area and being otherwise located inside the housing, there being located in the circuit a fan for circulating the process air and a drying chamber for holding objects to be dried, wherein the section is covered by a hood that is placed in sealing fashion on the wall area.

Such a condensation dryer originates from WO 2006/122840 A1. The tumble dryer described there has an electrical heater for the air used to dry laundry, the so-called process air and the process air is guided through a flow channel to the heater, with the flow channel being attached as a U-shaped profile on the outside to a rear side of a housing of the dryer and being covered by a hood. As a result of the flowing process air being covered twice, the loss of heat is reduced and acoustic insulation to counter noises caused by the flowing process air is improved.

In a condensation dryer, process air is routed by a fan via a heater into a drum containing damp items of laundry as a drying chamber. The hot air absorbs moisture from the items of laundry to be dried. After passing through the drum, the then moist process air is routed into a heat exchanger, upstream of which is generally connected a lint filter. The moist process air is cooled down in this heat exchanger, with the moisture carried along as steam being condensed and collecting under the heat exchanger in liquid form. The thus dehumidified process air once again flows to the heater and from there to the drum in order to absorb further moisture from the items of laundry.

This drying process is very energy-intensive, since the heat, which is extracted from the cold air flow when cooling the process air in the heat exchanger, is lost from the process in terms of energy. The use of a heat pump can significantly reduce this energy loss. In the case of a condensation dryer equipped with a heat pump, the cooling of the warm process air laden with moisture essentially takes place in a heat sink of the heat pump. This may be embodied as an evaporator, where the transmitted heat is used to evaporate a refrigerant circulating in a closed circuit. The refrigerant in the heat pump which is evaporated on account of heating is fed via a compressor to a condenser which functions as a heat source in the heat pump, where, on account of the condensation of the gaseous refrigerant, heat is released, which is used to heat the process air prior to entry into the drum. In this way the heat source adopts the function of the heater in the simple condensation dryer. The steam contained in the moist process air condenses in the heat sink. The condensed water is then generally collected in a suitable container.

A tumble dryer with a heat pump is described in DE 40 23 000 C2, in which a supply air opening is arranged in the process air channel between the heat source and the heat sink, said supply air opening being sealable with a controllable sealing facility.

A tumble dryer with a heat pump originates from WO 2008/107266 A1 and WO 2008/119611 A1. A heat pump in a tumble dryer is generally embodied as a compact unit and arranged below the drum for the items of laundry to be dried. An electrical heater for the process air is not present.

DE 20 2007 000 648 U1 discloses a tumble dryer with a drum for receiving laundry to be dried, a process air circuit for guiding process air and a heat pump circuit with a condenser, an evaporator, a throttle element and a compressor, with an additional heat exchanger being arranged in the heat pump circuit between the condenser and the throttle element. A tumble dryer is shown in FIGS. 2 to 5, said tumble dryer having a drum which can be loaded from the front, it being possible to rotate said drum about a horizontal axis. The process air passes from the drum interior through a filter or several filters in the appliance door, and then passes through the evaporator, the condenser, the fan and an optional additional heater and is guided through holes in the rear wall of the drum back into the drum. In order to guide the process air in the region of the evaporator and the condenser, these are arranged in a channel, which is formed by a channel housing. An air routing molded part which is arranged above the additional heat exchanger is used here to guide air in the region of the additional heat exchanger.

BRIEF SUMMARY OF THE INVENTION

An object of the invention is to provide a condensation dryer of the type defined in the introduction, wherein the guidance of the process air takes place in as favorable a fashion as possible and using as cost-effective means as possible. It should be possible to utilize possibilities for improving the function of the tumble dryer here.

This object is achieved according to this invention by means of a condensation dryer having the features of the independent claim. Preferred embodiments of the inventive condensation dryer are set out in the corresponding dependent claims.

The subject matter of the invention is thus a condensation dryer with a housing comprising a wall area forming a rear side and with a process air circuit for circulating process air, said circuit having a section outside the housing and running along the wall area and being otherwise located inside the housing, there being located in the circuit a fan for circulating the process air and a drying chamber for holding objects to be dried, wherein the section is covered by a hood that is placed in sealing fashion on the wall area. A heat pump with a heat sink thermally coupled to the process air circuit and with a heat source thermally coupled to the process air circuit is disposed in the housing, and the section located on the wall area is formed by a profile part placed on the wall area.

The hood may be formed from different materials. The hood is preferably made of metal. It may also be provided with an insulating layer for shielding against heat and/or sound. In particular, the hood is screwed to the wall area. A seal can be inserted between the hood and the wall area.

In a preferred embodiment of the invention, the heat source of the heat pump is the sole heater for the process air. The heat source here is preferably arranged in the process air circuit between the fan and an exit of the drying chamber.

A continuous gap is particularly preferably located between the process air circuit section and the hood.

The process air circuit section may be formed in one piece or several pieces and likewise from different materials. The process air circuit section is however preferably made of plastic. The plastic is particularly preferably a polypropylene plastic. The term "polypropylene plastic" is to be interpreted broadly here and includes propylene homopolymers and propylene copolymers, which consist of at least 50 percent by weight of propylene units. Propylene copolymers preferably contain ethylene and/or butylene polymerized in as comonomers. Furthermore, the propylene copolymers used according to the invention may be present as statistical copolymers or block copolymers.

If the process air section is made of plastic, it may particularly advantageously be produced in one piece in a manner known per se. The single piece process air section then covers both the fan and also the first and second opening. The use of plastic is then particularly advantageous if the heat source of the heat pump is the sole heater. In the absence of a conventional heater, in particular in the surroundings of the wall area and the section of the process air circuit there, particularly high local temperatures are not to be expected in this section. Low-cost materials with restricted thermal load capacity can therefore be used in the section.

A development of the inventive condensation dryer, wherein the fan is arranged in a recess of the wall area, is likewise preferred. The fan therefore forms a first end of the section on the wall area.

The heat source may be arranged at various points in the process air circuit and is located in particular inside or outside the process air circuit section. The heat source is preferably arranged outside the process air circuit section upstream of the fan.

The process air can be heated exclusively via the heat source of the heat pump. An electrical heater can however also be used.

A particularly preferred development of the inventive condensation dryer is characterized in that the section of the process air circuit on the wall area is connected to the drying chamber by way of a plurality of openings in the wall area. This is then particularly advantageous if the condensation dryer, in addition to the heat pump, does not have a heater positioned on the wall area. More space is therefore available on the wall area in order to create a favorable passage with the lowest possible pressure loss for the process air between the section and the drying chamber.

The drying chamber of the inventive condensation dryer is preferably a rotatable drum.

The heat pump of the condensation dyer preferably corresponds to the type of compressor heat pump. To this end, it is set up to circulate a refrigerant through the heat sink, which is an evaporator for the refrigerant, a compressor, which is set up to compress the refrigerant and drive the refrigerant through the heat pump, the heat source, which is a condenser for the refrigerant and a throttle for expanding the refrigerant. Fluorinated hydrocarbons are particularly considered as a refrigerant, in particular the fluorinated ethane derivatives R134a and R152a, mixtures of fluorinated hydrocarbons such as the known compounds R407C and R410A as well as propane and carbon dioxide.

The inventive condensation dryer preferably comprises an acoustic and/or optical display means for displaying one or several operating states. An optical display means may be a liquid crystal display for instance, on which certain requests or instructions are indicated. In addition or alternatively, light-emitting diodes can illuminate in one or several colors.

The inventive condensation dryer may include an air-air heat exchanger, which is preferably embodied so as to be detachable. This is particularly advantageous since lint can be cleaned more easily from a detachable heat exchanger.

If, in addition to the heat pump, a further heater is used in the inventive condensation dryer, this is preferably a two stage heater. Since the energy needed for the drying process reduces with an increasing degree of drying of the objects to be dried in the condensation dryer, it is expedient to control the heater correspondingly, i.e. to reduce its heating power with an increasing degree of drying in order to maintain a balance between the supplied drying energy and the necessary drying energy.

With an increasing degree of drying of the objects to be dried, in particular laundry, a lower heating power or even an increasing cooling power of the heat pump thus becomes necessary. The temperature in the process air circuit would in particular increase significantly after a drying phase has concluded. The heat pump and where applicable an additional heater in the condensation dryer is therefore generally regulated such that a maximum permissible temperature is not exceeded in the drying chamber.

In order to monitor the temperature of the refrigerant and/or heat pump and if necessary the temperature of the process air, temperature sensors, which are known per se to the person skilled in the art, are generally used in the heat pump circuit and/or in the process air circuit.

The invention is advantageous in that the process air can be routed into the drying chamber with an optimized flow. This reduces pressure losses. Improved thermal insulation is possible in embodiments of the invention.

BRIEF DESCRIPTION OF THE DRAWINGS

Exemplary embodiments of the invention will emerge from the subsequent description of the drawing and its partially schematized FIGS. 1 and 3, in which.

DETAILED DESCRIPTION OF EXEMPLARY EMBODIMENTS OF THE PRESENT INVENTION

Figure 1:
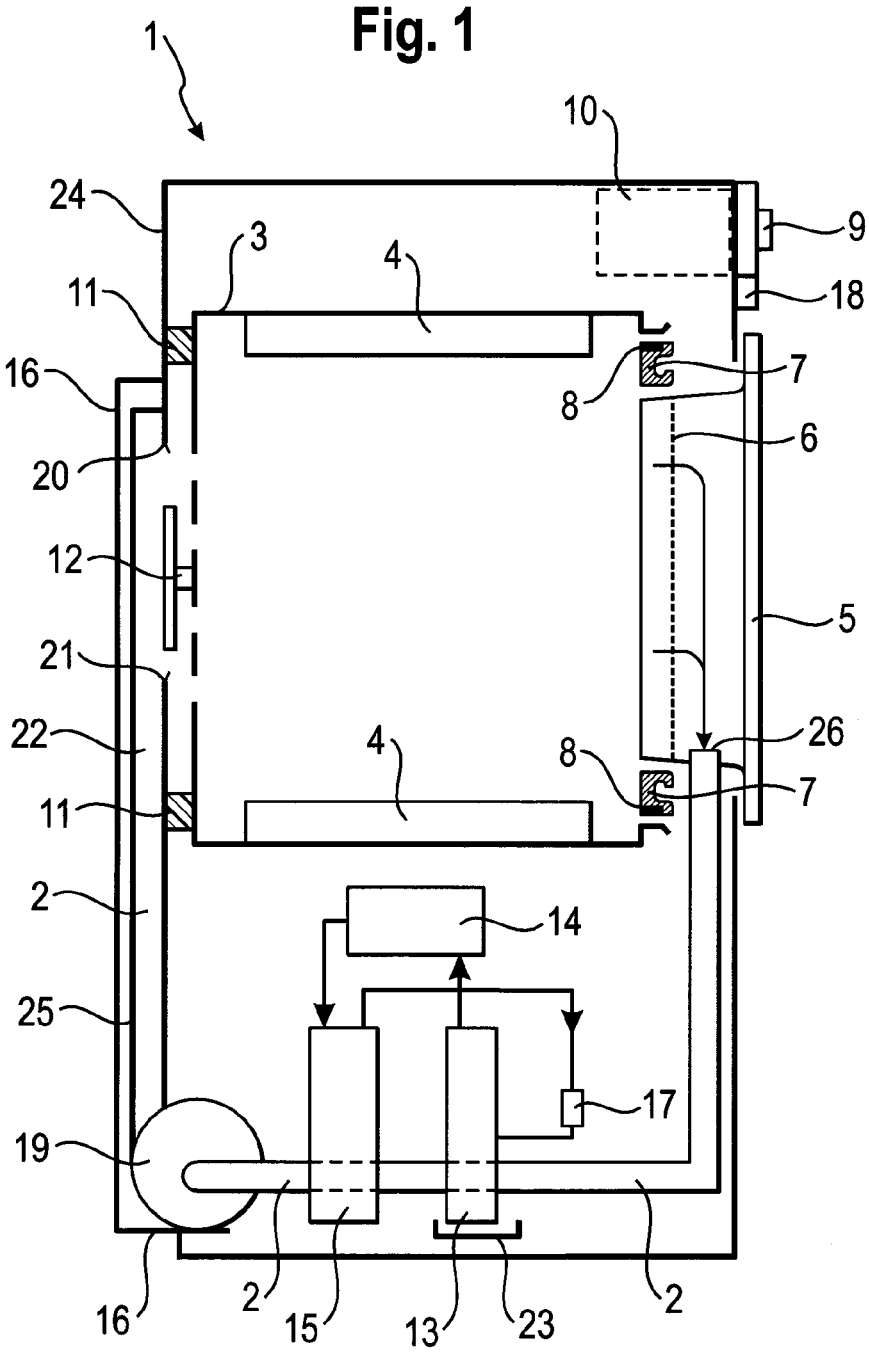
FIG. 1 shows a detailed view of a vertical section through a condensation dryer according to a first embodiment.

FIG. 1 shows a vertical section through a condensation dryer 1 (subsequently abbreviated to "dryer" 1) according to a first embodiment, in which the heating of the process air is exclusively carried out by way of the condenser 15 of the heat pump 13, 14, 15, 17 which functions as a heat source 15.

The dryer 1 shown in FIG. 1 comprises a drum 3 which can be rotated about a horizontal axis as a drying chamber 3, within which agitators 4 are fastened to move laundry during the rotation of the drum 3. Process air is guided through a drum 3 and a heat pump 13, 14, 15, 17 in an air channel in the closed circuit by means of a fan 19 (process air circuit 2). After passing through the drum 3, the moist, warm process air is cooled down and is heated again after the moisture contained in the process air has condensed. Heated air is routed here from the rear, i.e. from the side of the drum 3 opposite a door 5, through its perforated base into the drum 3, comes into contact there with the laundry to be dried and flows through the fill opening of the drum 3 to a lint filter 6 within a door 5 closing off the fill opening. The air flow is then diverted downward in the door 5 and guided in the air channel 2 via an exit 26 to the evaporator 13 of a heat pump 13, 14, 15, 17 which functions as a heat sink 13, where it is cooled. Refrigerant evaporated here in the evaporator 13, which circulates in the heat pump 13, 14, 15, 17, is routed via a compressor 14 to the condenser 15. In the condenser 15 the refrigerant condenses as it releases heat to the process air. The refrigerant which is now present in liquid form is then routed via a throttle 17 back to the evaporator 13, as a result of which a refrigerant circuit is closed. A condensate tub 23, in which the condensate which occurs during the cooling of the moist, damp process air is collected, is located below the evaporator 13. The condensate may be disposed of for instance by mechanical emptying or pumping away out of the condensate tub 23.

The section 22 of the process air circuit 2 from the fan 19 to the drum 3 is considered in more detail below. The section 22 lies outside the housing 24 delimited by a wall area 24 on a rear side of the dryer 1, whereas the process air circuit is otherwise arranged inside the housing 24. The section 22 is formed between the fan 19 and openings 20 and 21 in the wall area 24, through which the process air flows out of the section 22 through the correspondingly perforated base into the drum 3. A seal 11 is arranged between the base of the drum 3 and the wall area 24.

Said section 22 is formed between the wall area 24 and a profile part 25 placed thereupon, which is embodied in one piece and is made of a polypropylene plastic. The profile part 25 defines a flow channel in the section 22, through which flow channel the process air can flow in a controlled fashion and without significant pressure loss from the fan 19 to the openings 20 and 21. The profile part 25 is for its part covered by a hood 16, leaving a continuous gap between the profile part 25 and the hood 16. The hood is made of metal, namely a molded metal sheet, and is additionally provided with an insulating layer (not shown for reasons of clarity). In this way the hood 16 provides excellent insulation against heat losses and operating noises.

The fan 19 is embodied as a radial fan and is arranged in a recess of the wall area 24. It therefore adjoins the section 22 simply and in a fashion that is favorable for flow purposes.

The heat pump 13, 14, 15, 17 with all its components is arranged completely in the housing 24 of the dryer 1 and thus outside the section 22. The condenser 15 here forms the single heat source 15 in the dryer 1 which is essential for the drying process.

The drum 3 is mounted in the embodiment shown in FIG. 1 on the rear base by means of a pivot bearing 12 and to the front by means of a bearing bracket 7, with the drum 3 resting with a flange on a sliding strip on the bearing bracket 7 and thus being held at the front end. The condensation dryer is controlled by way of a controller 10, which can be regulated by the user by way of a control unit 9. Different states of the condensation dyer can be optically or acoustically displayed by means of a display apparatus 18.

Figure 2C:
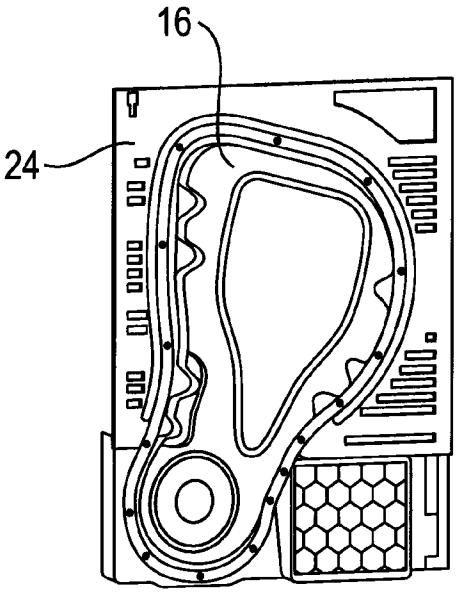
FIG. 2 shows detailed top views of a process air circuit section from a fan to the entry of the process air into a drum, with the views a), b) and c) differing in that in a) a process air circuit section and a hood are detached, in b) only the hood is detached and in c) the hood shown therein covers the process air circuit section arranged therebelow.
Figure 2B:
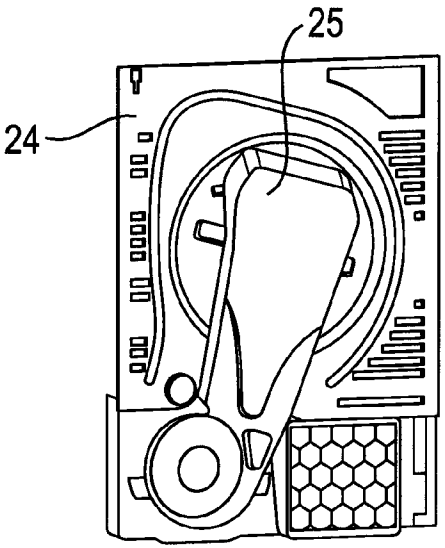
Figure 2A:
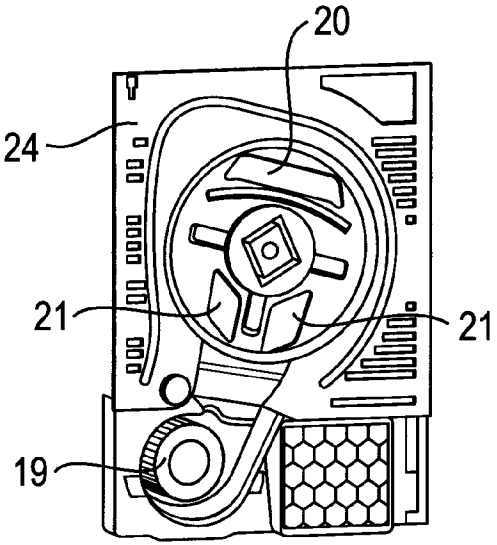

By way of example, FIG. 2 shows top views of the section 22 from the fan 19 to the entry of the process air into a drum 3 (not shown in greater detail here). The views a), b) and c) differ in that in FIG. 2*a*) the profile part 25 and a hood 16 are detached, in FIG. 2*b*) only the hood 16 is detached and in FIG. 2*c*) the hood 16 shown therein covers the profile part 25 arranged therebelow.

FIG. 2*a*) shows a first opening 20 and a second opening 21, with, in the embodiment shown in FIG. 2*a*), the second opening 21 consisting of two mirror-symmetrically arranged square partial openings. The process air flows into the drum 3 by way of both openings 20 and 21. In FIG. 2*b*) the part of the profile part 25 shown here covers the first opening 20 and the second openings 21. The process air flows in the part of the process air channel 2 (section 22) shown here from the fan 19 to the drum 3 (likewise not shown in greater detail here).

Figure 3:
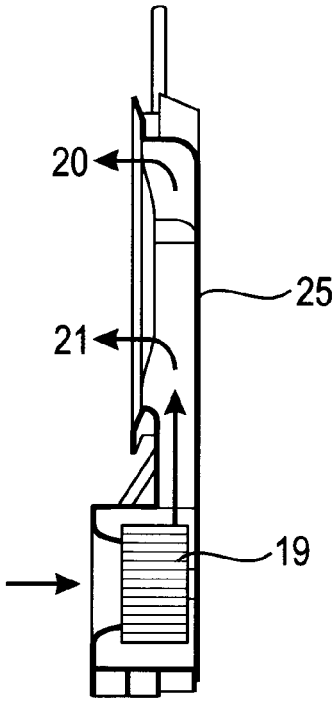
FIG. 3 shows a detailed side view of the process air channel shown in FIG. 2.

FIG. 3 shows a side view of the profile part 25 shown in FIG. 2. The arrows show the flow direction of the heated process air coming from the condenser 15 (not shown here) via the fan 19 through the process air circuit section to the openings 20 and 21.

The invention claimed is:

1. A condensation dryer, comprising:

a housing comprising a wall area forming a rear side;

a process air circuit for circulating process air, said process air circuit having a first section outside the housing and running along the wall area and a remaining second section located inside the housing, said first section being formed by a profile part placed on the wall area;

a hood covering the first section in sealing fashion on the wall area; and a fan arranged in the process air circuit for circulating process air;

a drying chamber arranged in the process air circuit for holding objects to be dried; and a heat pump disposed in the housing, said heat pump having a heat sink thermally coupled to the process air circuit and a heat source thermally coupled to the process air circuit.

2. The condensation dryer of claim 1, wherein the heat source is the sole heater for the process air and is arranged in the process air circuit between the fan and an exit of the drying chamber.

3. The condensation dryer of claim 1, wherein the profile part and the hood define a continuous gap there between.

4. The condensation dryer of claim 1, wherein the profile part is made of a plastic.

5. The condensation dryer of claim 4, wherein the plastic is a polypropylene plastic.

6. The condensation dryer of claim 1, wherein the fan is arranged in a recess of the wall area.

7. The condensation dryer of claim 1, wherein the heat source is arranged outside the first section upstream of the fan.

8. The condensation dryer of claim 1, wherein the first section is connected to the drying chamber by way of a plurality of openings in the wall area.

9. The condensation dryer of claim 1, wherein the drying chamber is a rotatable drum.

10. The condensation dryer of claim 1, wherein the heat pump is constructed to circulate a refrigerant through the heat sink within a closed refrigerant circuit, said heat sink being configured in the form of an evaporator for the refrigerant, and said heat source being configured in the form of a condenser, said heat pump comprising a compressor upstream of the condenser to compress the refrigerant and to drive the refrigerant through the refrigerant circuit, and a throttle for expanding the refrigerant received from the condenser.

* * * * *